US012220054B2

(12) United States Patent
Bercy

(10) Patent No.: US 12,220,054 B2
(45) Date of Patent: Feb. 11, 2025

(54) FOLDABLE DOOR TRAY

(71) Applicant: Jacques Boutchy Bercy, Hampton, GA (US)

(72) Inventor: Jacques Boutchy Bercy, Hampton, GA (US)

( * ) Notice: Subject to any disclaimer, the term of this patent is extended or adjusted under 35 U.S.C. 154(b) by 0 days.

(21) Appl. No.: 17/950,469

(22) Filed: Sep. 22, 2022

(65) Prior Publication Data

US 2023/0089362 A1 Mar. 23, 2023

Related U.S. Application Data

(60) Provisional application No. 63/246,839, filed on Sep. 22, 2021.

(51) Int. Cl.
*A47B 5/04* (2006.01)
*A47B 5/02* (2006.01)

(52) U.S. Cl.
CPC . *A47B 5/04* (2013.01); *A47B 5/02* (2013.01)

(58) Field of Classification Search
CPC ..... A47B 5/04; A47B 5/02
USPC ..... 108/42, 47, 48, 60–61; 312/3–6, 312/242–245
See application file for complete search history.

(56) References Cited

U.S. PATENT DOCUMENTS 194,971 A * 9/1877 Morgan ..... A47B 95/008 211/88.01
2,095,227 A * 10/1937 Brown ..... A61F 17/00 16/374
4,128,285 A * 12/1978 Lore ..... A47B 37/00 312/196
5,170,719 A * 12/1992 Pestone ..... A47B 5/04 211/104
5,570,642 A * 11/1996 Lehrman ..... D06F 81/06 248/240.4
5,653,178 A * 8/1997 Huczka ..... A47B 96/067 108/135
7,303,077 B2 * 12/2007 Harlocker ..... G06F 1/1628 248/205.2
7,304,839 B1 * 12/2007 Burns ..... G06F 1/1603 361/679.55
7,421,958 B2 * 9/2008 Ciulla ..... A47B 5/06 108/44
7,585,368 B2 * 9/2009 Lin ..... B05B 15/80 118/500
7,739,964 B2 * 6/2010 Hatton ..... F16M 13/02 108/135

(Continued)

*Primary Examiner* — Daniel J Troy
*Assistant Examiner* — Timothy M Ayres
(74) *Attorney, Agent, or Firm* — Gutwein Law; Tyler B. Droste

(57) ABSTRACT

A foldable tray assembly configured for hanging on an exterior surface of a door. More particularly, the invention relates to a device configured to support and accept delivered items to facilitate a more hygienic mechanism for no contact delivery. The assembly is comprised of a hanger portion, a tray portion, and a cover portion configured for fitment together to form a cohesive and assembled device. The hanger portion is generally configured to allow for placement of the device along a vertical surface of a door the device is placed upon, the tray portion provides a resting surface for a delivered item, and the cover portion provides a protective enclosure. The tray portion and cover portion are capable of hinged movement between a pair of positions.

17 Claims, 16 Drawing Sheets

(56) References Cited

U.S. PATENT DOCUMENTS

| | | | | |
|---|---|---|---|---|
| 7,810,655 | B2 * | 10/2010 | Wang | A47G 29/08 248/327 |
| 8,857,347 | B1 * | 10/2014 | Liu | A47B 5/02 108/47 |
| 9,089,206 | B2 * | 7/2015 | Baylor | A47B 3/08 |
| 9,301,623 | B2 * | 4/2016 | Herdman | A47D 5/003 |
| 9,357,839 | B1 * | 6/2016 | Liu | A47B 5/02 |
| 10,512,325 | B2 * | 12/2019 | Mitchell | A47G 29/00 |
| 10,959,546 | B2 * | 3/2021 | Kressin | A47G 25/0614 |
| 11,109,705 | B2 * | 9/2021 | Raphael | A47G 29/141 |
| 2003/0223119 | A1 * | 12/2003 | Heiman | A45C 3/02 359/601 |
| 2008/0067139 | A1 * | 3/2008 | Claypool | A47B 96/061 211/205 |
| 2012/0079965 | A1 * | 4/2012 | Gentry | A47B 5/00 108/151 |

* cited by examiner

FOLDABLE DOOR TRAY

CROSS REFERENCE TO RELATED APPLICATIONS

This U.S. Patent application claims priority to U.S. Provisional Patent Application No. 63/246,839 filed 22 Sep. 2021 to the above-named inventor of which the disclosure is considered part of the disclosure of this application and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The invention relates generally to a foldable tray assembly configured for hanging on an exterior surface of a door. More particularly, the invention relates to a device configured to support and accept delivered items to facilitate a more hygienic mechanism for no contact delivery.

BACKGROUND

With recent advances in delivery services and due to the transmissive nature of the COVID-19 virus, more and more individuals and businesses are ordering items to be delivered. Often, these deliveries are considered "no contact," wherein the delivered item is left at a door or a specific location for later pickup. In a typical dwelling, this delivery is left in close proximity to the door and is often placed onto the floor, stoop, porch, or directly on the ground. This is generally an undesirable and unsanitary location for the placement of food items. Further, this location requires a user to completely exit the dwelling to retrieve the item. Still further, to prevent this position, people often utilize an additional object, such as a table, to generally provide a delivery surface that is raised off of the surface.

Within the prior art, the use of a hanging table or tray placed upon a vertical surface is generally associated with use in a vehicle, upon a cabinet door, or associated with a seating apparatus. US Pat. Appl. Publ. No. 2009/0140023 entitled "Eat On The Go Travel Tray For Auto Window Or Lap" provides a tray assembly that is configured for hanging on a vertical surface to form a generally perpendicular tray for the placement of food items. This tray assembly, although useful, lacks certain features dedicated to receive a delivered food item and configured for use in an outdoor environment requiring hygienic properties.

U.S. Pat. No. 7,621,496 entitled "Hanging Storage Tray" is an apparatus configured for suspension from a chair, ladder, or other implement for storing accessories and items. This tray assembly, although useful, also lacks certain features dedicated for use in receiving a delivered food item and configured for adjustable use in an outdoor environment requiring hygienic properties. U.S. Pat. No. 7,118,001 entitled "Over Door Storage Rack For Cabinet Doors" is generally related to a storage rack for hanging on an upper edge of a door within a cabinet interior space and including features to enable hanging in multiple positions and configurations. The device of this assembly, although useful, lacks additional features to enable for adjustable use in an outdoor environment requiring hygienic properties and does not enable the use of certain protective items to generally enclose the delivered/placed item.

SUMMARY OF THE INVENTION

It would be advantageous to have an apparatus that is specifically configured to enable a more convenient and hygienic delivery solution. Preferably, this apparatus is adapted to be hung from a door along an exterior surface. This placement allows the apparatus to move with the door opening, wherein a delivered item is easily available within the interior. When a user opens their door, the delivery comes with it! They don't have to step outside or bend down to get it, making the apparatus perfect for people with limited accessibility. Furthermore, it would also be advantageous to have an apparatus that is foldable in an unobtrusive manner when not in use. Still further, it would be advantageous to have an apparatus that is also covered from the elements. Therefore, there currently exists a need in the market for an apparatus that is specifically configured to hold food deliveries for later retrieval at a position that is located above the ground surface and upon a door.

The invention advantageously fills the aforementioned deficiencies by providing a foldable door tray assembly, which provides a sanitary receptable for receiving delivered food.

The invention can generically be described as a tray assembly for hanging on a door for receiving a delivered item.

The device is generally comprised of a hanger portion, a tray portion, and a cover portion configured for fitment together to form a cohesive and assembled device.

The hanger portion is generally configured to allow for placement of the device along a vertical surface of a door the device is placed upon, wherein the hanger portion is generally comprised of a support coupled over a top edge of the door for securing the device to the door. The support is generally comprised of a free end opposite an attached end with a distance between the free end and the attached end defining a length of the support. The attached end generally having a hook-like shape, wherein the attached end extends generally perpendicular to the length a distance roughly corresponding to a thickness of the door for placement over the upper edge of the door.

The support including a plurality of apertures along the length extending between the free end and the attached end. The plurality of apertures generally providing a means for securing the tray portion and the cover portion to the support through a fastener. In a preferred assembly of the device, the hanger portion is generally comprised of a pair of supports with each of the support and a second support generally mirroring each other. Accordingly, the second support has a free end and an attached end opposed a length being a distance between the free end and the attached end. The attached end generally having a hook-like shape, wherein the attached end extends generally perpendicular to the length a distance roughly corresponding to a thickness of the door for placement over the upper edge of the door.

In this preferred assembly, the support and the second support provide a secure mounting surface for the receipt of the tray portion and cover portion, wherein the pair of supports are generally spaced a distance apart, with this distance generally corresponding to a width of the tray portion to provide a balanced and robust assembly for hanging.

The tray portion is generally comprised of a rear wall and a tray surface hingedly received in a coupling with the rear wall. The rear wall generally being a planar surface configured for attachment along the length of the supports and defining a rear most portion of an interior space. The rear wall having an upper edge, a lower edge, a first side, and a second side, with the edges and the sides in communication to define the planar shape of the rear wall. The rear wall most generally providing the main attachment surface for the cover member structures and tray surface, wherein the rear wall edges and sides include corresponding apertures or other structures to allow for the coupling of parts in a cohesive and cooperative assembly.

The tray surface generally being a planar and rigid surface configured to support an item, such as, but not limited to, a food delivery. The tray surface planar structure generally defined by an area bound by a front edge, a rear edge, a first side, and a second side in communication to form the perimeter shape of the tray surface. A portion of the tray surface perimeter including a raised edge, wherein the raised edge is generally perpendicular to the tray surface and configured to maintain placed items on the planar tray surface and provide an attachment surface for coupling. The tray surface hingedly coupled to the rear wall by affixing the first side and the second side adjacent the rear edge to the rear wall first side and second side adjacent the lower edge. In the preferred assembly, this hinged coupling utilizes a fastener in the form of a hinge pin received in a corresponding aperture of the respective structure. This fastener generally allowing for articulation of the tray surface relative to the rear wall, wherein the tray surface is movable from a stored position (parallel to the hanger portion along the door height) to a fixed position (perpendicular to the hanger portion length along the door height).

The cover portion most generally configured as a movable surround to shield the interior space and any items placed on the tray surface. The cover portion including a top member, a first side curtain, and a second side curtain. Each of the top member, first side curtain and second side curtain generally hingedly movable from a stored position to a protective position. Accordingly, the top member is generally configured for positioning above the tray surface to protect items on the tray. The top member hingedly coupled to the rear wall at an attached end with the top member positioned perpendicular to the hanger length upon the door in the protective position and positioned parallel to the hanger in the stored position, with the top member generally movable in an upward and downward direction relative to the door the device is hung upon.

Each of the first side curtain and the second side curtain having an attached end and a free end opposite the attached end with the attached end hingedly coupled to the rear wall. Accordingly, each of the first side curtain and the second side curtain are hingedly movable in a side direction, wherein the first side curtain and second side curtain are rotated between the stored position and the protective position.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
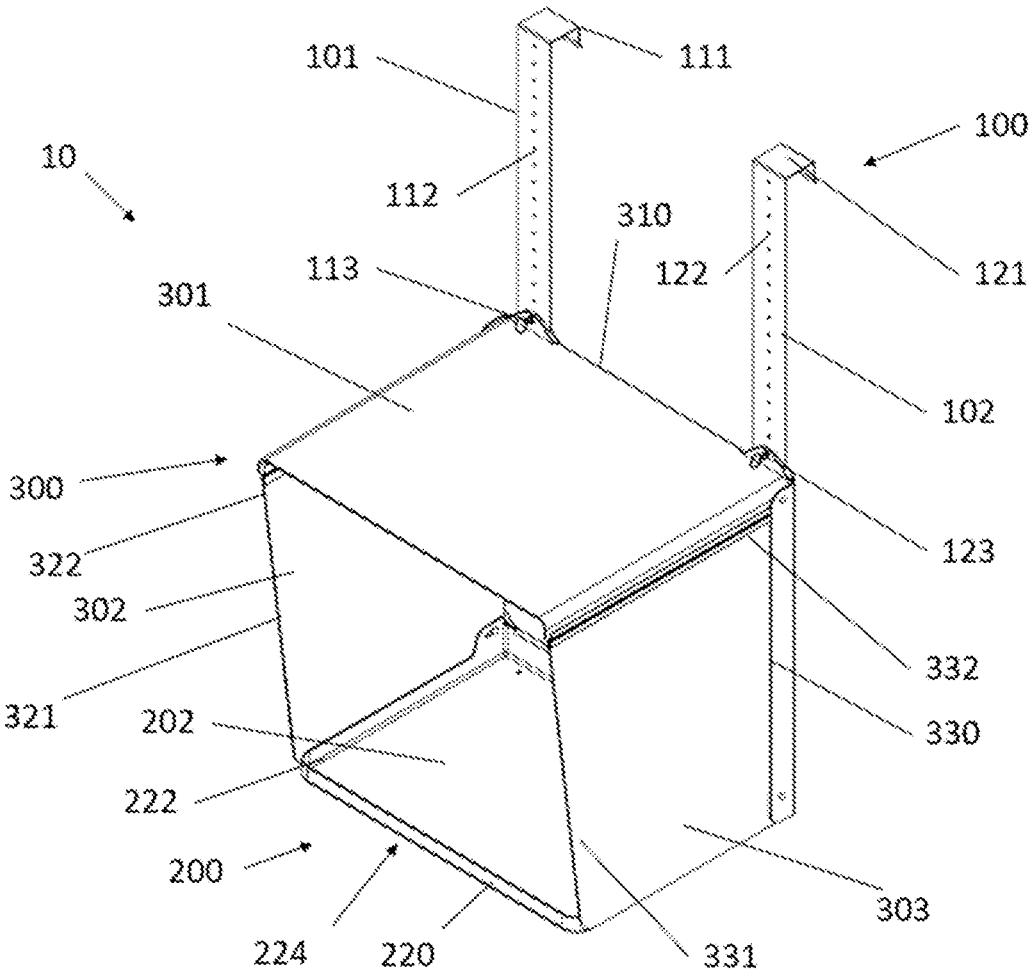
FIG. 1 is an isometric view of the folding door tray in an open position, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS., with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The invention of the present disclosure is most generally related to an assembly to allow for placement along a door for the receipt of delivered items. Preferably, this assembly includes a foldable assembly and adjustable features to accommodate a variety of items and specifically no contact delivery of food items.

Figure 2:
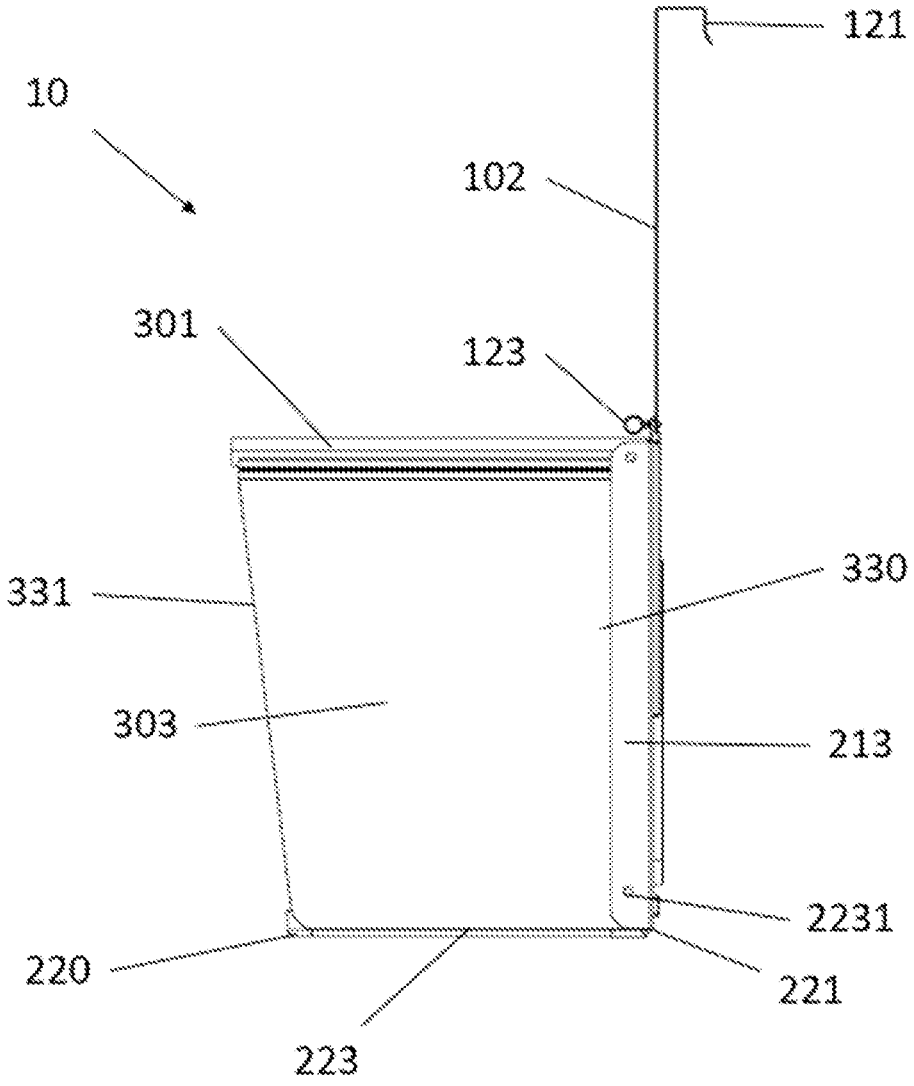
FIG. 2 is a side view of the folding door tray in the open position, according to the present disclosure.
Figure 3:
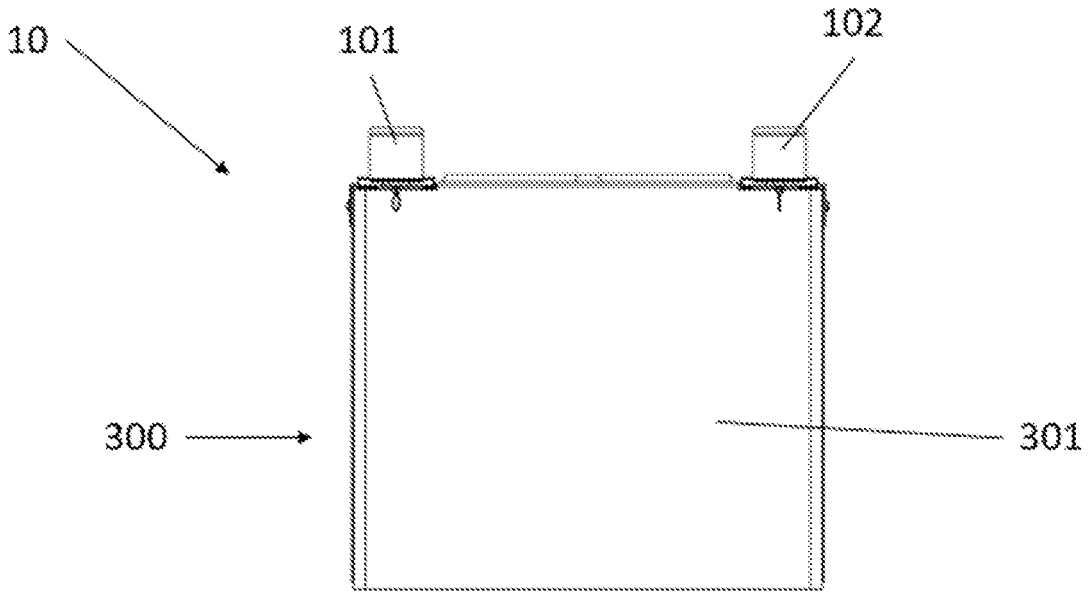
FIG. 3 is a top side view of the folding door tray in the open position, according to the present disclosure.
Figure 4:
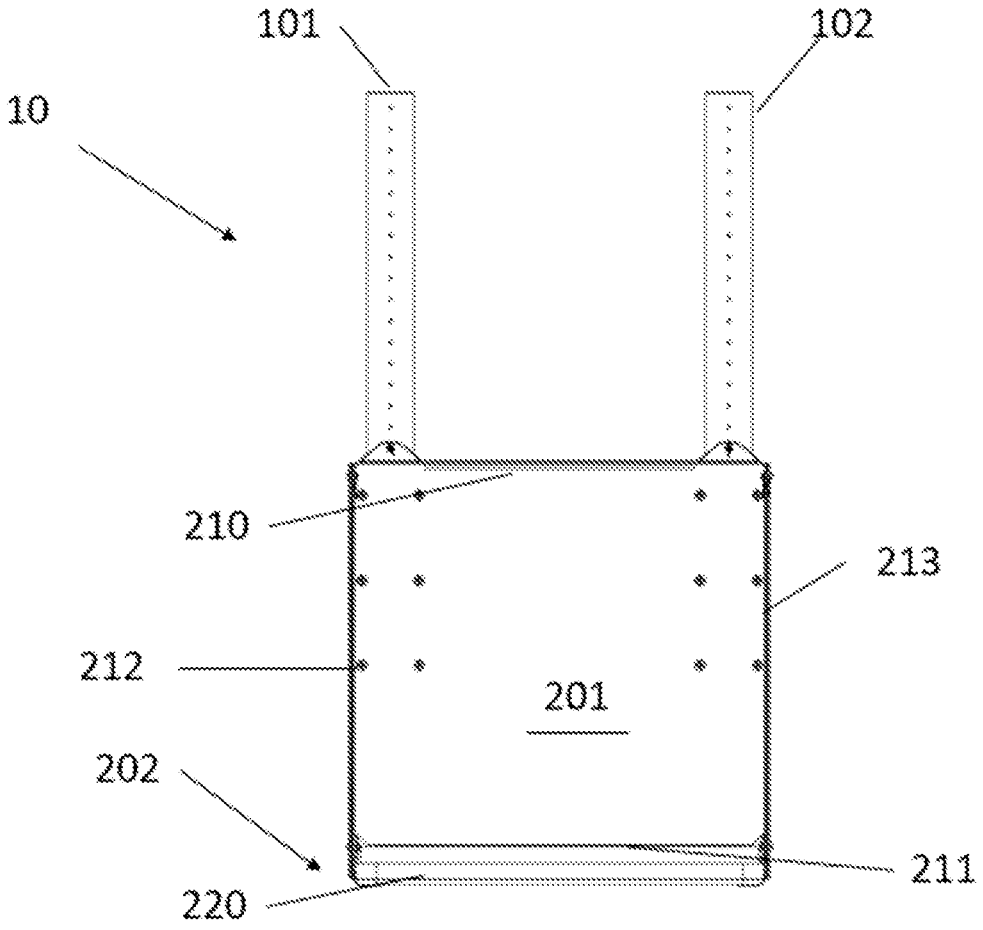
FIG. 4 is a front side view of the folding door tray in the open position, according to the present disclosure.
Figure 5:
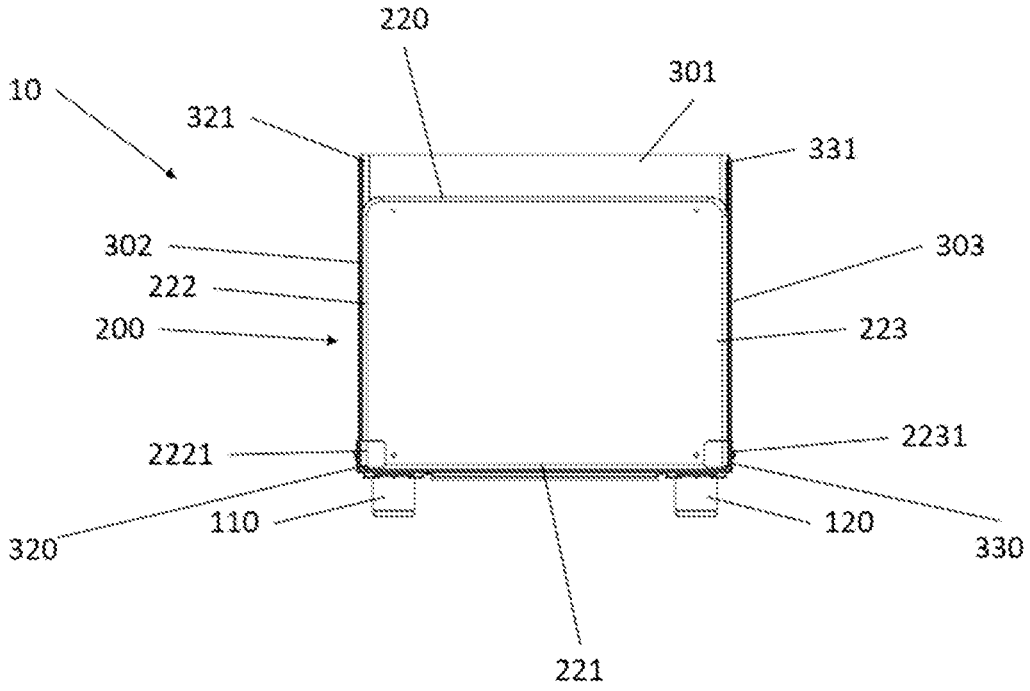
FIG. 5 is a bottom side view of the folding door tray in the open position, according to the present disclosure.
Figure 6:
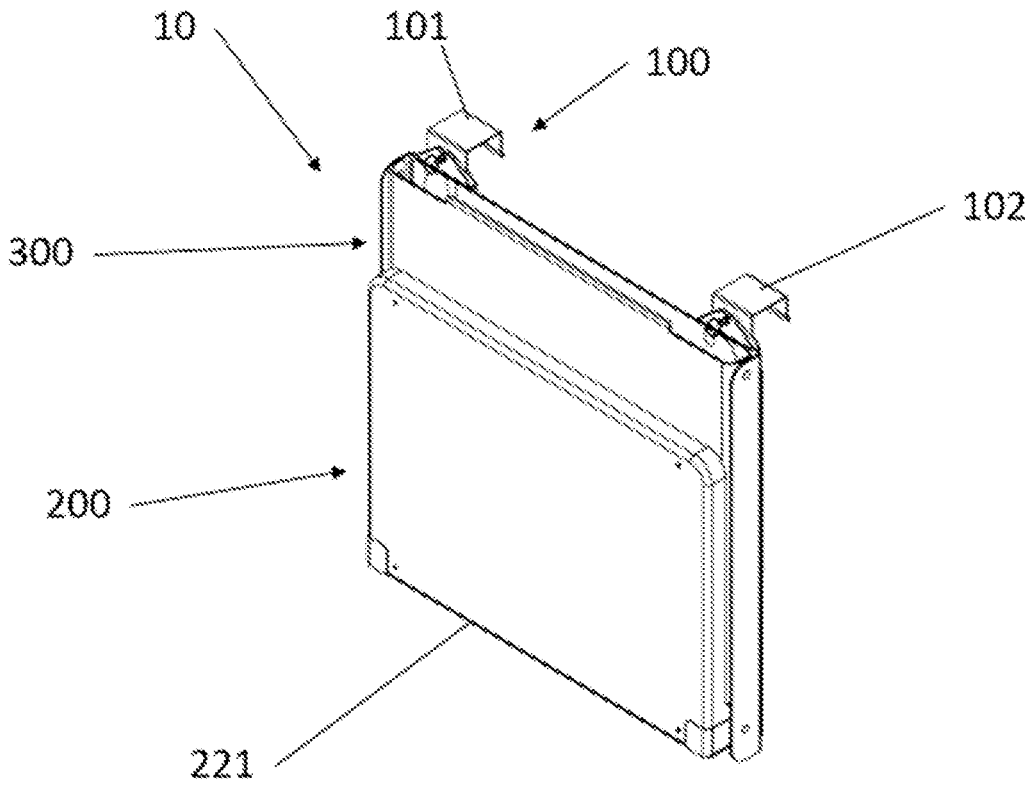
FIG. 6 is an isometric view of the folding door tray in a closed position, according to the present disclosure.
Figure 7:
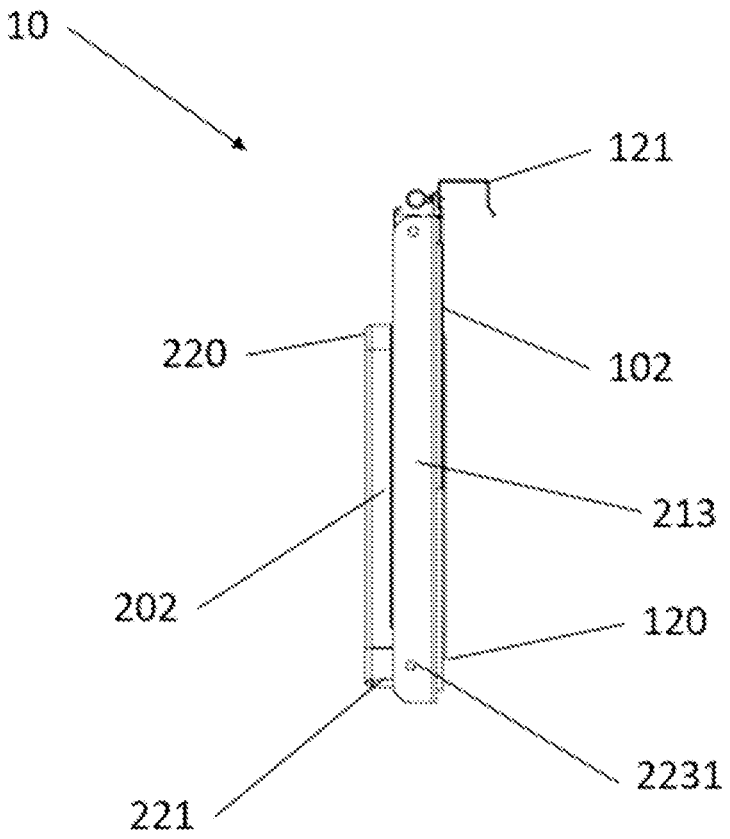
FIG. 7 is a side view of the folding door tray in the closed position, according to the present disclosure.
Figure 8:
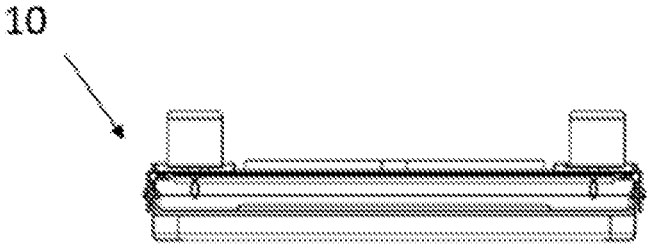
FIG. 8 is a top side view of the folding door tray in the closed position, according to the present disclosure.
Figure 9:
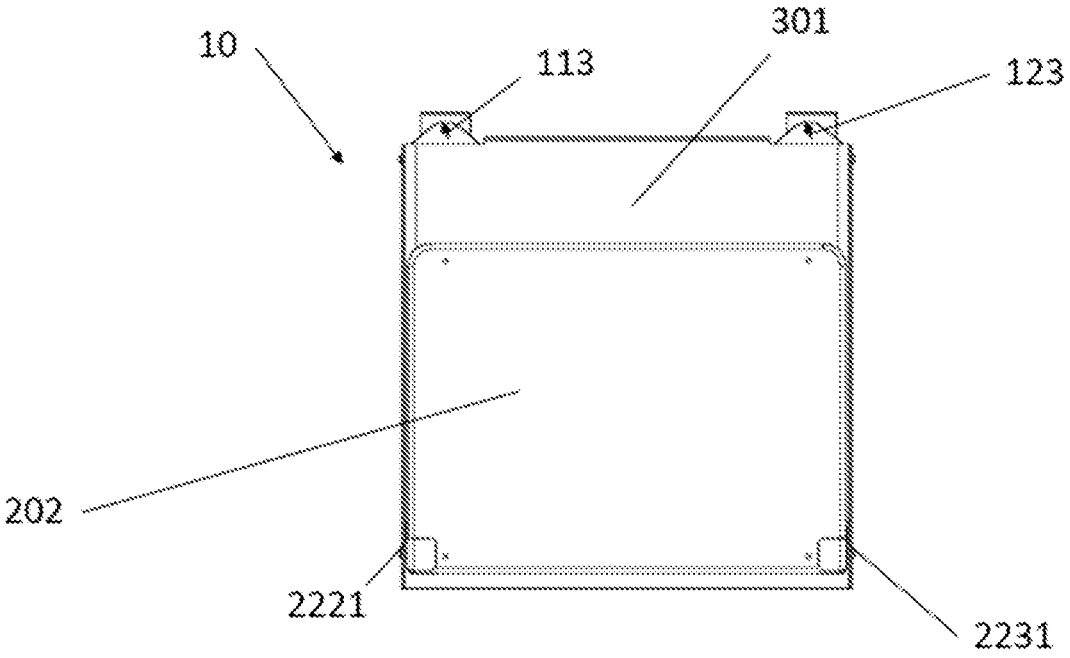
FIG. 9 is a front side view of the folding door tray in the closed position, according to the present disclosure.
Figure 10:
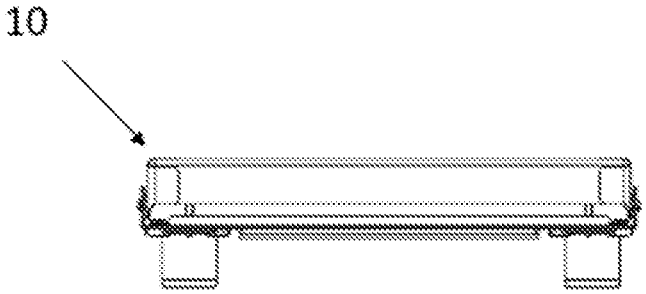
FIG. 10 is a bottom side view of the folding door tray in the closed position, according to the present disclosure.
Figure 11:
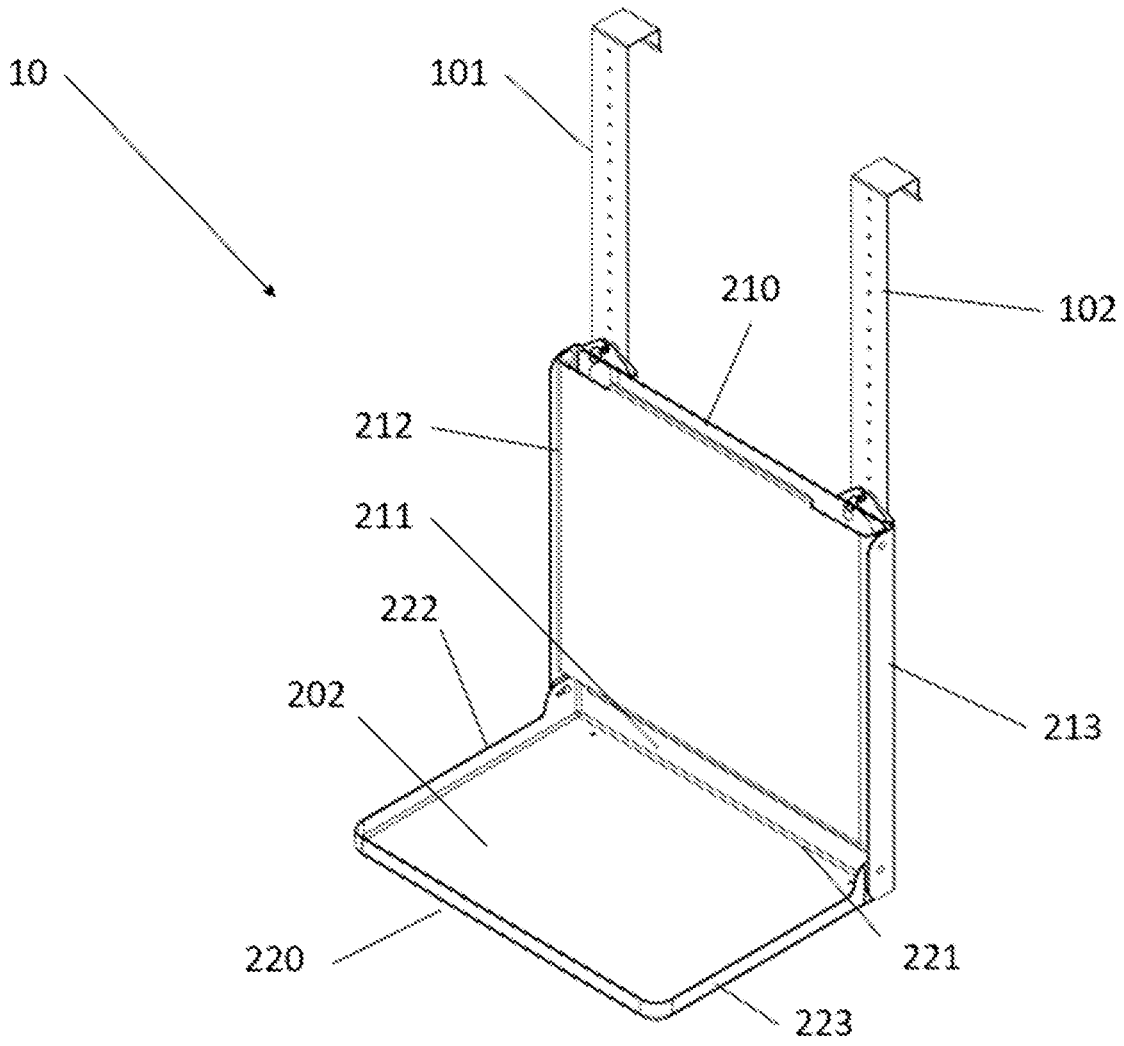
FIG. 11 is an isometric view of the folding door tray in a partially open position, according to the present disclosure.
Figure 12:
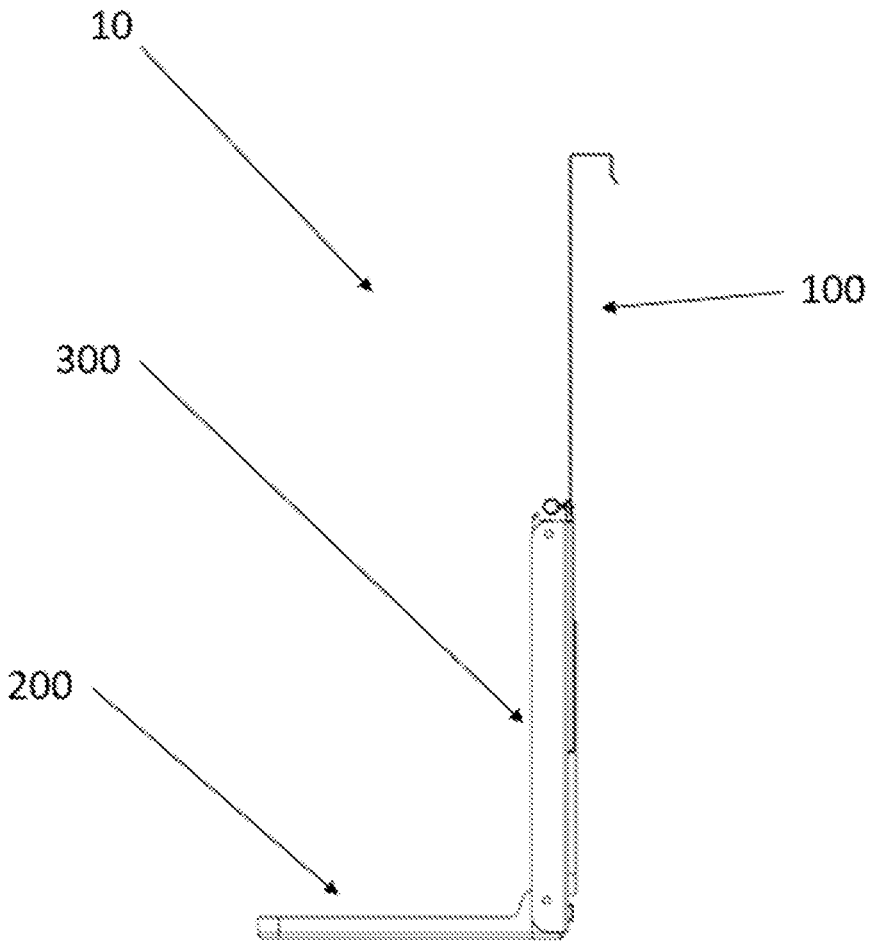
FIG. 12 is a side view of the folding door tray in the partially open position, according to the present disclosure.
Figure 13:
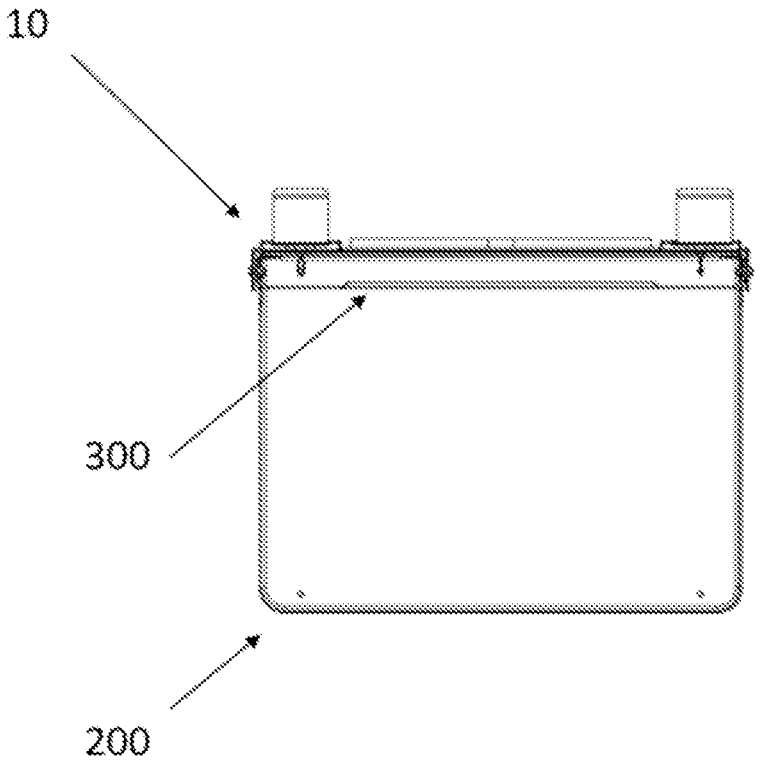
FIG. 13 is a top side view of the folding door tray in the partially open position, according to the present disclosure.
Figure 14:
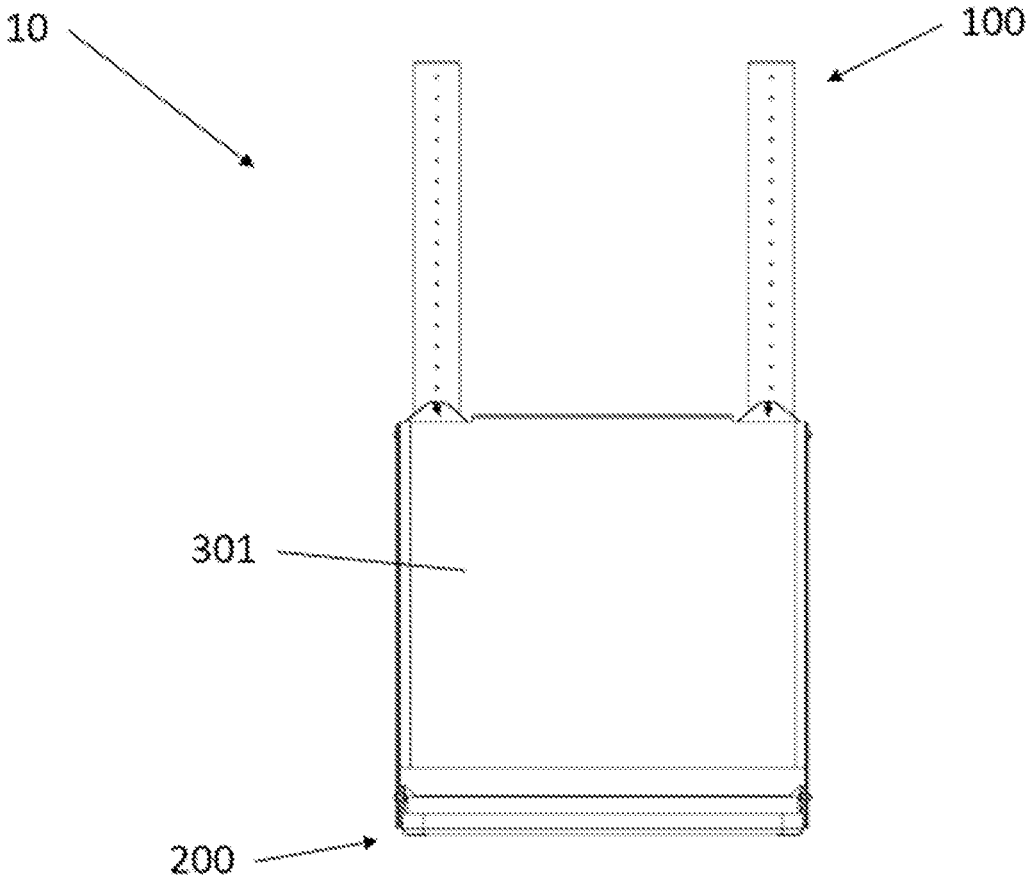
FIG. 14 is a front side view of the folding door tray in the partially open position, according to the present disclosure.
Figure 15:
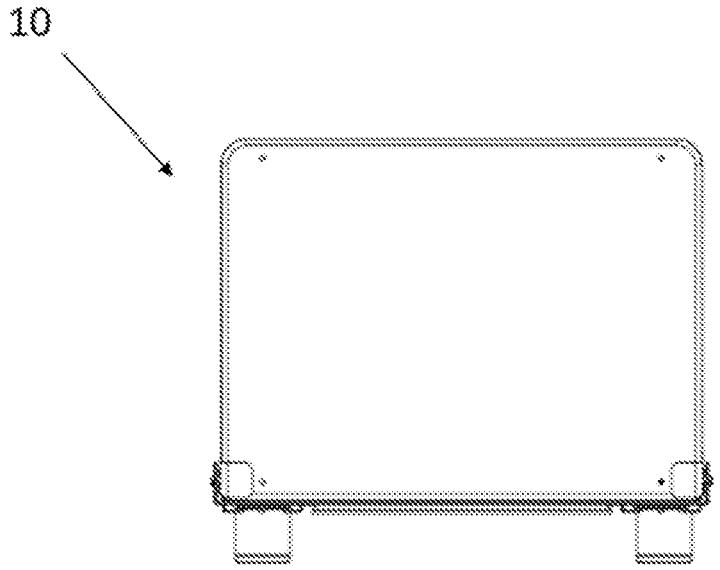
FIG. 15 is a bottom side view of the folding door tray in the partially open position, according to the present disclosure.
Figure 16:
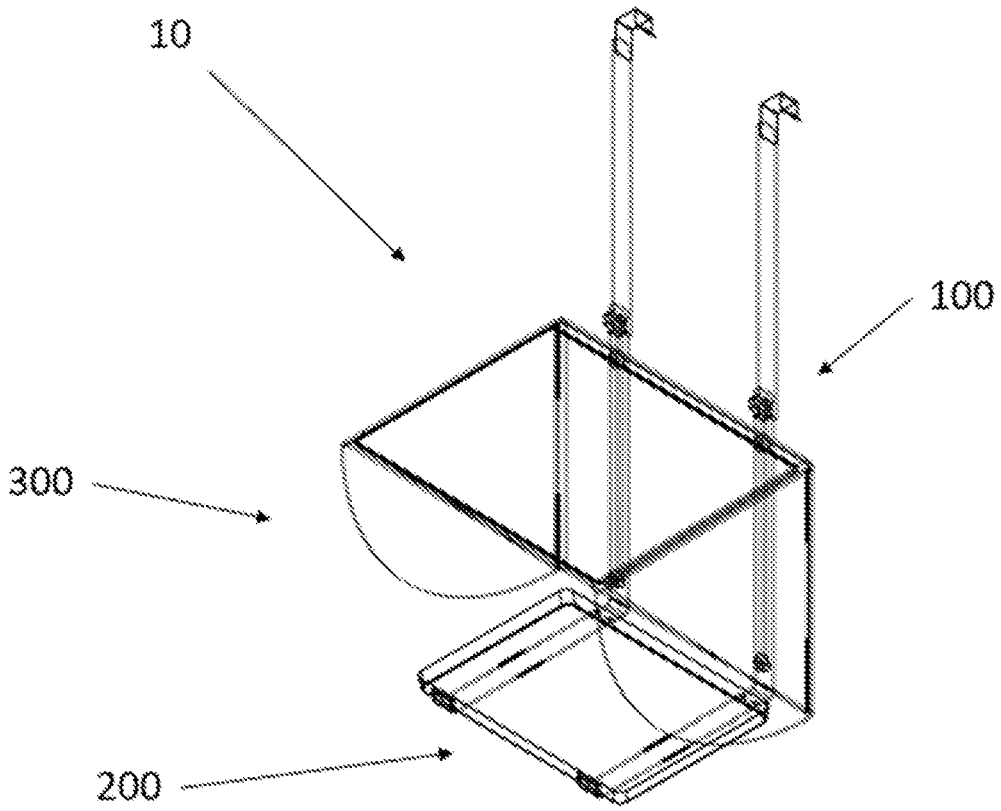
FIG. 16 is an isometric view of an alternate embodiment of the folding door tray, according to the present disclosure.

Referring to the figures, FIG. 1-FIG. 16 show a foldable door tray according to the present disclosure and generally referred to herein as device 10. The device 10 is generally comprised of a hanger portion 100, a tray portion 200, and a cover portion 300 configured for fitment together to form a cohesive and assembled device 10.

The hanger portion 100 is generally configured to allow for placement of the device 10 along a vertical surface of a door the device 10 is placed upon, wherein the hanger portion 100 is generally comprised of a support 101 coupled over a top edge of the door for securing the device 10 to the door. The support 101 is generally comprised of a free end 110 opposite an attached end 111 with a distance between the free end 110 and the attached end 111 defining a length of the support 101. The attached end 111 generally having a hook-like shape, wherein the attached end 111 extends generally perpendicular to the length a distance roughly corresponding to a thickness of the door for placement over the upper edge of the door. Accordingly, the attached end 111 of the support 101 has a size and shape for receipt over the top edge of the door by extending over the thickness of the door from an exterior side to an interior side culminating in a hook-shape. The attached end 111 size generally selected for universal fitment over multiple door thickness. Alternately, the support 101 length and attached end 111 may include features to enable adjustment (FIG. 16), wherein both the length of the support 101 and generally perpendicular length of the attached end 111 may be adjusted to accommodate a plurality of door thicknesses and sizes.

The support 101 including a plurality of apertures 112 along the length extending between the free end 110 and the attached end 111. The plurality of apertures 112 generally providing a means for securing the tray portion 200 and the cover portion 300 to the support 101 through a fastener 113 in the rear wall 201.

In a preferred assembly of the device 10, the hanger portion 100 is generally comprised of a pair of supports 101, 102 with each of the support 101 and a second support 102 generally mirroring each other. Accordingly, the second support 102 has a free end 120 and an attached end 121 opposed a length being a distance between the free end 120 and the attached end 121. The attached end 121 generally having a hook-like shape, wherein the attached end 121 extends generally perpendicular to the length a distance roughly corresponding to a thickness of the door for placement over the upper edge of the door. Accordingly, the attached end 121 of the second support 102 has a size and shape for receipt over the top edge of the door by extending over the thickness of the door from an exterior side to an interior side culminating in a hook-shape. The attached end 121 size generally selected for universal fitment over multiple door thickness. Alternately, the attached end 121 may include features to enable adjustment, wherein the generally perpendicular length may be adjusted to accommodate a plurality of door thicknesses. The second support 102 including a plurality of apertures 122 along the length extending between the free end 120 and the attached end 121. The plurality of apertures 122 generally providing a means for securing the tray portion 200 and the cover portion 300 to the support 102 through a fastener 123.

In this preferred assembly, the support 101 and the second support 102 provide a secure mounting surface for the receipt of the tray portion 200 and cover portion 300, wherein the pair of supports 101, 102 are generally spaced a distance apart, with this distance generally corresponding to a width of the tray portion 200 to provide a balanced and robust assembly for hanging.

The tray portion 200 is generally comprised of a rear wall 201 and a tray surface 202 hingedly received in a coupling with the rear wall 201. The rear wall 201 generally being a planar surface configured for attachment along the length of the supports 101, 102 and defining a rear most portion of an interior space. The rear wall 201 having an upper edge 210, a lower edge 211, a first side 212, and a second side 213, with the edges 210, 211 and the sides 212, 213 in communication to define the planar shape of the rear wall 201. The rear wall 201 most generally providing the main attachment surface for the cover member 300 structures and tray surface 202, wherein the rear wall 201 edges 210, 211 and sides 212, 213 include corresponding apertures or other structures to allow for the coupling of parts in a cohesive and cooperative assembly. In the preferred embodiment of the device 10, this rear wall is generally rectangular in shape and fastened directly to the hanger portion 100.

The tray surface 202 generally being a planar and rigid surface configured to support an item, such as, but not limited to, a food delivery. The tray surface 202 planar structure generally defined by an area bound by a front edge 220, a rear edge 221, a first side 222, and a second side 223 in communication to form the perimeter shape of the tray surface 202. A portion of the tray surface 202 perimeter including a raised edge 224, wherein the raised edge 224 is generally perpendicular to the tray surface 202 and configured to maintain placed items on the planar tray surface 202 and provide an attachment surface for coupling. The tray surface 202 hingedly coupled to the rear wall 201 by affixing the first side 222 and the second side 223 adjacent the rear edge 221 to the rear wall 201 first side 212 and second side 213 adjacent the lower edge 211. In the preferred assembly, this hinged coupling utilizes a fastener 2221, 2231 in the form of a hinge pin received in a corresponding aperture of the respective structure. This fastener 2221, 2231 generally allowing for articulation of the tray surface 202 relative to the rear wall 201, wherein the tray surface 202 is movable from a stored position (parallel to the hanger portion 101 length along the door height) to a fixed position (perpendicular to the hanger portion 101 length along the door height). Accordingly, the device 10 tray portion 200 is generally shown in the stored position in FIGS. 6-10.

The cover portion 300 most generally configured as a movable surround to shield the interior space and any items placed on the tray surface 202. The cover portion 300 including a top member 301, a first side curtain 302, and a second side curtain 303. Each of the top member 301, first side curtain 302, and second side curtain 303 generally hingedly movable from a stored position (FIGS. 6-16) to a protective position (FIGS. 1-5). Accordingly, the top member 301 is generally configured for positioning above the tray surface 202 to protect items on the tray 200. The top member 301 hingedly coupled to the rear wall 201 at an attached end 310 with the top member 301 positioned perpendicular to the hanger 101 length upon the door in the protective position and positioned parallel to the hanger 101 in the stored position, with the top member 301 generally movable in an upward and downward direction relative to the door the device 10 is hung upon.

Each of the first side curtain 302 and the second side curtain 303 having an attached end 320, 330 and a free end 321, 331 opposite the attached end with the attached end 320, 330 hingedly coupled to the rear wall 201. Accordingly, each of the first side curtain 302 and the second side curtain 303 are hingedly movable in a side direction, wherein the first side curtain 302 and second side curtain are 303 rotated between the stored position and the protective position. The first side curtain 302 and the second side curtain 303 generally configured to protect the sides of the interior space and the items on the tray surface 202. The first side curtain 302 and the second side curtain 303 additionally configured to provide resting support for the top member 301 along an upper edge 322, 332.

The device 10 assembled structures are generally capable of placement into three distinct configurations. In a first configuration of the device 10 (FIGS. 1-5) the tray portion 200 and cover portion 300 are in the fixed position and the protective position. In this first configuration the cover portion 300 and tray portion generally define the interior space and protect this defined interior space from the elements. In a second configuration of the device 10 (FIGS. 6-10), the tray portion 200 and cover portion 300 are in the stored position, wherein the device 10 is in the smallest configuration for storage, shipping, or transport. In a third configuration of the device 10 (FIGS. 11-15), the tray portion 200 is in the fixed position and the cover member 300 is in the protective position. In this configuration, the tray portion 200 can generally be used support objects/items, but the tray surface 202 is not protected but the physical shielding the cover portion 300 provides.

The device 10 can utilize a multitude of materials for the features and construction, wherein the device 10 features and structures can be comprised of multiple materials and material types. The device 10 tray surface 202 may include a plurality of indentations, including, but not limited to, a cup shaped indentation. Alternately, the cover portion 300 may be configured for removable attachment to the hanger portion 101 through the use of magnets, as opposed to the use of fasteners. Alternately, the cover portion 300, hanger support 100, and tray portion 200 may include additional features and structures to provide for assembly and use in a manner that does not harm or mar the door the device 10 is placed upon. These may include, but not be limited to, foam or resilient material or cushioned pads, a tightening mechanism to secure the device, and various structural supports.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A tray assembly configured for vertical hanging from a door to receive a delivered item, the tray assembly comprising:

a hanger portion, the hanger portion providing a support structure for placement over the door, the hanger portion having:

an attached end, the attached end being curved in shape;

a free end, the free end opposite the attached end;

a length, the length extending between the free end and the attached end; and a plurality of apertures along the length, the plurality of apertures providing an attachment surface;

a tray portion, the tray portion providing a resting planar and rigid surface for receipt of the item, the tray portion having:

a rear wall, the rear wall being a planar surface configured for attachment to the hanger portion; and a tray surface, the tray surface hingedly coupled to the rear wall, wherein the tray surface is movable between a position parallel to the rear wall and perpendicular to the rear wall; and a cover portion, the cover portion generally providing a movable surround for the tray surface, the cover portion having:

a top member, the top member hingedly coupled to the rear wall and movable between a position parallel to the rear wall and perpendicular to the rear wall to generally cover the tray surface;

a first side curtain; and a second side curtain, each of the first side curtain and the second side curtain hingedly coupled to the rear wall and movable between a position parallel to the rear wall in a storage position and perpendicular to the rear wall to protect a side of the tray surface in a protective position, wherein the tray assembly can be moved between a plurality of configurations, wherein the plurality of positions include a first configuration, a second configuration, and a third configuration.

2. The tray assembly as in claim 1, wherein the hanger portion is comprised of a support and a second support.

3. The tray assembly as in claim 2, wherein the hanger portion length is adjustable.

4. The tray assembly as in claim 2, wherein the rear wall is secured to the support and the second support with a fastener.

5. The tray assembly as in claim 2, wherein the rear wall is secured to the support and the second support with a magnetic coupling.

6. The tray assembly as in claim 1, wherein the tray surface includes a raised edge.

7. A foldable door tray assembly configured for vertical hanging from a door to receive a delivered item, the foldable door tray comprising:

a hanger portion, the hanger portion providing a support structure for placement over the door, the hanger portion having:

an attached end, the attached end being curved in shape having a size configured for receipt over a top edge of the door;

a free end, the free end opposite the attached end;

a length, the length extending between the free end and the attached end; and a plurality of apertures spaced equally along the length, the plurality of apertures providing an attachment surface;

a tray portion, the tray portion providing a resting surface for receipt of the item, the tray portion having:

a rear wall, the rear wall being a planar surface configured for attachment to the hanger portion, the rear wall having an upper edge, a lower edge, a first side, and a second side; and a tray surface, the tray surface being a rigid planar surface having a front edge, a rear edge, a first side, and a second side, the tray surface hingedly coupled to the rear wall at the lower edge along the first side and the second side adjacent the rear edge, wherein the tray surface is movable between a position parallel to the rear wall and perpendicular to the rear wall; and a cover portion, the cover portion generally providing a movable surround for the tray surface, the cover portion having:

a top member, the top member hingedly coupled to the rear wall and movable between a position parallel to the rear wall and perpendicular to the rear wall to generally cover the tray surface;

a first side curtain; and a second side curtain, each of the first side curtain and the second side curtain hingedly coupled to the rear wall and movable between a position parallel to the rear wall in a storage position and perpendicular to the rear wall to protect a side of the tray surface in a protective position, wherein the tray assembly can be moved between a plurality of configurations, wherein the plurality of positions include a first configuration, a second configuration, and a third configuration.

8. The tray assembly as in claim 7, wherein the hanger portion is comprised of a support and a second support.

9. The tray assembly as in claim 8, wherein the hanger portion length is adjustable.

10. The tray assembly as in claim 8, wherein the rear wall is secured to the support and the second support with a fastener.

11. The tray assembly as in claim 8, wherein the rear wall is secured to the support and the second support with a magnetic coupling.

12. The tray assembly as in claim 7, wherein the tray surface includes a raised edge.

13. A foldable door tray assembly configured for vertical hanging from a door to receive a delivered item, the foldable door tray comprising:

a hanger portion, the hanger portion providing a support structure for placement over the door, the hanger portion comprised of a support and a second support, each of the support and the second support having:

an attached end, the attached end being curved in shape having a size configured for receipt over a top edge of the door;

a free end, the free end opposite the attached end;

a length, the length extending between the free end and the attached end; and a plurality of apertures spaced equally along the length, the plurality of apertures providing an attachment surface;

a tray portion, the tray portion providing a resting surface for receipt of the item, the tray portion having:

a rear wall, the rear wall being a planar surface configured for attachment to the hanger portion, the rear wall having an upper edge, a lower edge, a first side, and a second side; and a tray surface, the tray surface being a rigid planar surface having a front edge, a rear edge, a first side, and a second side, the tray surface hingedly coupled to the rear wall at the lower edge along the first side and the second side adjacent the rear edge, wherein the tray surface is movable between a position parallel to the rear wall and perpendicular to the rear wall; and a cover portion, the cover portion generally providing a movable surround for the tray surface, the cover portion having:

a top member, the top member having an attached end and a free end, the attached end hingedly coupled to the rear wall and movable between a position parallel to the rear wall and perpendicular to the rear wall to generally cover the tray surface;

a first side curtain; and a second side curtain, each of the first side curtain and the second side curtain hingedly coupled to the rear wall and movable between a position parallel to the rear wall in a storage position and perpendicular to the rear wall to protect a side of the tray surface in a protective position, wherein the tray assembly can be moved between a plurality of configurations, wherein the plurality of positions include a first configuration, a second configuration, and a third configuration.

14. The tray assembly as in claim 13, wherein the hanger portion length is adjustable.

15. The tray assembly as in claim 13, wherein the rear wall is secured to the support and the second support with a fastener.

16. The tray assembly as in claim 13, wherein the rear wall is secured to the support and the second support with a magnetic coupling.

17. The tray assembly as in claim 13, wherein the tray surface includes a raised edge.

* * * * *